US010132103B2

(12) United States Patent
Karnutsch et al.

(10) Patent No.: US 10,132,103 B2
(45) Date of Patent: Nov. 20, 2018

(54) ACTUATION HANDLE

(71) Applicant: HOPPE AG, Lana (BZ) (IT)

(72) Inventors: Elias Karnutsch, Nauders (AT); Oliver Erich Rudolf Schuberth, Laas (IT)

(73) Assignee: HOPPE AG, Lana (BZ) (IT)

( * ) Notice: Subject to any disclaimer, the term of this patent is extended or adjusted under 35 U.S.C. 154(b) by 687 days.

(21) Appl. No.: 14/664,905

(22) Filed: Mar. 22, 2015

(65) Prior Publication Data

US 2015/0275544 A1 Oct. 1, 2015

(30) Foreign Application Priority Data

Mar. 25, 2014 (DE) ..... 10 2014 104 141

(51) Int. Cl.
*E05B 1/00* (2006.01)
*E05B 3/06* (2006.01)
*E05B 15/00* (2006.01)

(52) U.S. Cl.
CPC ..... *E05B 1/003* (2013.01); *E05B 3/06* (2013.01); *E05B 15/0053* (2013.01); *E05B 3/065* (2013.01); *E05B 2015/0066* (2013.01); *Y10T 292/57* (2015.04); *Y10T 292/82* (2015.04); *Y10T 292/85* (2015.04); *Y10T 292/854* (2015.04)

(58) Field of Classification Search
CPC . Y10T 292/82; Y10T 292/85; Y10T 292/854; E05B 3/06; E05B 3/065
USPC ..... 292/347–349
See application file for complete search history.

(56) References Cited

U.S. PATENT DOCUMENTS 1,575,330 A * 3/1926 Goodman ..... E05B 3/06 70/216
4,773,240 A * 9/1988 Foshee ..... E05B 17/0058 70/222
5,364,139 A * 11/1994 Bergen ..... E05B 13/004 292/169
5,787,743 A * 8/1998 Weigard ..... E05B 17/0058 292/336.3

(Continued)

FOREIGN PATENT DOCUMENTS

DE 7709636 12/1977
DE 3320061 A1 12/1984

(Continued)

*Primary Examiner* — Carlos Lugo
(74) *Attorney, Agent, or Firm* — Reinhart Boerner Van Deuren P.C.

(57) ABSTRACT

An actuation handle having a handle, having a handle neck and rotatably connected to an installation body, is provided. The handle connects to an actuation element in the door or window via a driver. Two detent elements engage in at least one functional position of the handle. An axially movable, non-rotatably mounted detent ring includes a first detent element. A counter detent ring includes a second detent element that corresponds to the first detent element. A guide sleeve provides a non-rotating receptacle for the driver, aligns centrally with the rotary axis of the handle, and has guide elements along its inner circumference. The detent ring has an opening and has guide elements along its outer circumference. The detent ring is inserted into the guide sleeve and the opening receives the driver, while its guide elements are engaged with the guide elements of the guide sleeve in an axially movable manner.

12 Claims, 7 Drawing Sheets

(56) References Cited

U.S. PATENT DOCUMENTS

| | | | | |
|---|---|---|---|---|
| 6,527,314 | B2 * | 3/2003 | Brown | E05B 13/005 292/336.3 |
| 6,601,270 | B2 * | 8/2003 | Eckhardt | E05B 3/00 16/412 |
| 8,070,194 | B2 * | 12/2011 | Houis | E05B 3/00 16/412 |
| 8,210,580 | B2 * | 7/2012 | Engel | E05B 15/0053 292/252 |
| 8,733,806 | B2 * | 5/2014 | Kuppelwieser | E05B 3/04 292/336.3 |

FOREIGN PATENT DOCUMENTS

| | | | | | |
|---|---|---|---|---|---|
| DE | 3320193 | A1 | | 12/1984 | |
| DE | 3320193 | | | 9/1986 | |
| DE | 29703682 | | | 6/1997 | |
| DE | 4227973 | | | 9/1997 | |
| DE | 202008005829 | | | 8/2008 | |
| DE | 202008006021 | U1 | | 8/2008 | |
| DE | 202009013586 | | | 1/2010 | |
| DE | 102011008758 | | | 7/2012 | |
| EP | 460297 | A1 | * | 12/1990 | |
| EP | 0838565 | A1 | | 4/1998 | |
| EP | 2112301 | B1 | | 3/2011 | |
| EP | 2476823 | A2 | * | 7/2012 | E05B 3/00 |
| EP | 2543795 | A2 | * | 1/2013 | E05B 3/06 |
| EP | 2486204 | B1 | | 9/2013 | |
| JP | 06026247 | A | * | 2/1994 | E05B 1/00 |

* cited by examiner

ACTUATION HANDLE

BACKGROUND OF THE INVENTION

Field of the Invention

The invention relates to an actuation handle for a door or window.

Actuation handles for doors and windows are generally known in accordance with the current state of the art. They are composed of an installation body that can be fixed on a door leaf or window profile, as well as a handle that is mounted on the installation body in an axially fixed, but rotatable manner, and that forms a working connection with an actuation element in the door leaf or window profile via a driver in order to open or close the door or window, for example using a lock follower or gear socket.

In order to facilitate the finding of the different functional positions of that actuation element, a number of latching elements are provided between the handle and the installation body, which engage in such a manner upon reaching the defined angular position (functional position) of the handle with respect to the installation body that a higher amount of torque is required to rotate the handle while in this functional position than is required while the handle is outside of one of these functional positions. The latter are thereby clearly perceptible to the user. These aforementioned latching elements are often arranged along the circumference, on a handle neck extending from the handle or in a connected non-rotatable locking plate as well as in a corresponding fashion on the installation body itself. These latching elements are often composed of lugs, catches, detents, protrusions, guide balls, or the like, which radially engage with the corresponding latching indentations in a spring-loaded manner (see, for example, German Utility Model No. DE 297 03 682 U1 or German Utility Model No. DE 20 2008 005 829 U1 in this regard).

German Patent Specification No. DE 42 27 973 C3, on the other hand, uses an axially-acting latching element. To this end, a handle is rotatably mounted inside a bearing bushing together with a neck bearing, wherein an actuation shaft joint (a square spindle) of the handle engages with a locking actuation element that is rotatably mounted inside a fitted housing. The neck bearing is composed of a flanged bushing that is mounted on the actuation shaft joint in an axially movable manner and which is loaded by a coil spring surrounding the actuation shaft joint that is supported by the handle neck of the handle element itself. The flanged bushing that is non-rotatably mounted on the square spindle and the bearing bushing provided inside the door leaf in a non-twisting manner are designed as axially-acting latch parts, while the flanged bushing and the bearing bushing are equipped with latching elements on their opposing front surfaces, preferably radial ribs, which engage with the corresponding radial grooves.

German Patent Specification No. DE 33 20 192 C2 uses axially ascending wedge segments as the latching and restoring measures for door fittings, which are axially positioned on the front surface of the bushing, though they are non-rotatable due to spring pressure. The wedge segments engage with the complementary wedge sections of a guiding collar, which is fixed inside the installation body in a non-twisting manner using a screw. This allows for the handle to be loaded with a restoring force in the closing direction regardless of the assigned lock itself, so that the lock and the handle always return to their home positions autonomously. The axially-movable bushing is prevented from twisting by two lateral protrusions inside the handle neck.

German Patent Application Publication No. DE 10 2011 008 758 A1 proposes to move the axially-movable latching elements into the installation body. For this purpose, the first latching mechanism is positioned on the front surface of the handle neck facing the installation body, while a receptacle that is concentrically aligned with the rotary axis is provided within the installation body, wherein a gliding body with a second latching mechanism is mounted in parallel with the rotary axis in an axially-movable manner. The gliding body is spring-loaded in the direction of the handle neck, wherein the second latching element in the functional positions of the handle is engaged with the first latching mechanism. To this end, a spring package is arranged between the gliding body and the base of the receptacle, which permanently presses the gliding body against the front surface of the handle neck.

The previously known actuation handles and/or fittings suffer from the disadvantage that many of them require complicated special components, which are often too complicated and expensive to manufacture and which have to be inserted into special recesses provided inside the door or window. A crucial disadvantage of the known solutions is therefore that it is not possible to mount these actuation handles on standard doors or window profiles, since the predefined standard holes and/or recesses cannot be used for the assembly. This means that special solutions deviating from this standard or additional holes are required, which has prevented a wide usage and cost-effective application of these actuation handles. Furthermore, it is always required that special recesses are provided inside the handle neck, which also has negative effects on manufacturing costs. A quick and cost-efficient mounting of these actuation handles on a standard door or window is thereby not possible.

It is also considered problematic that disassembly of these actuation handles often requires special tools, which are inserted laterally into an opening of the gears in order to actuate the safety locking mechanism of the square spindle. Such openings are not provided for standard gears and standard window profiles. The fact that elements that are mounted in an axially-movable manner can easily tilt or become jammed, which might impair the latching function as well as the functioning of the actuation handle as a whole, is problematic as well.

It would be desirable to avoid these and other disadvantages of the current state of the art and to design an actuation handle that is an essentially simple and cost-effective design and that can be easily and quickly mounted on standard windows and doors. This actuation handle should also be more cost-effective to manufacture and should offer a high degree of stability and reliability during operation. It would also be beneficial to develop an actuation handle with an installation body for a door and/or window handle that is inexpensively constructed with a simple mechanism and that ensures a visually unified and closed appearance while also significantly reducing the construction height of the installation body. It would also be beneficial for the installation body to be easier to handle and to also be capable of withstanding higher stresses in a permanent manner.

SUMMARY OF THE INVENTION

An actuation handle for a door or window with a handle that is equipped with a handle neck that is rotatably connected with an installation body has the handle forming an operative connection with an actuation element in the door or window by means of a driver, wherein the installation body can be fixed on the door or window detent elements, which engage with each other in at least one functional position of the handle in a force-locking and/or positive-locking manner, wherein the first detent element is provided on a detent ring which can be moved in an axial direction and is mounted inside the handle neck in a non-rotatable manner with a second detent element that is correspondingly arranged and provided on a counter detent ring which is fixed to the installation body in a non-twisting manner, and wherein a compression-spring is arranged inside the handle neck that pushes the detent ring against that counter detent ring in the axial direction. In accordance with various aspects and embodiments of the present invention, it may be provided that:

- the handle neck is provided with a guiding sleeve, which serves as a non-rotatable receptacle for the driver in a central position with regard to the rotary axis of the handle and which is provided with guide elements along its inner circumference;
- the detent ring is provided with an identically shaped opening in regard to the driver in a central position as aligned with the rotary axis of the handle and is similarly provided with guide elements along its outer circumference; and
- that the detent ring is inserted into the guide sleeve, while its opening serves as a receptacle for the driver and wherein its guide elements engage with the guide elements on the guide sleeve in an axially-movable fashion.

The positioning of the detent ring inside the handle neck of the handle and the arrangement of the counter detent ring on the installation body results in no movable detent elements being located on the installation body itself, which can therefore be designed to be very flat. Also, no detent elements or their opposite mating detent elements are housed inside the door leaf or window profile any more, so that an actuation handle in accordance with the invention described herein can be mounted on any standard door or window at any time. The guide sleeve inserted into the handle neck ensures an extremely stable and precise axial bearing and guidance of the detent ring, wherein the guide elements on its outer circumference engage with the guide elements along the inner circumference of the guide sleeve, while the detent ring with its central opening surrounds the driver itself. The actuation handle in accordance with this invention thereby ensures a permanently high degree of stability and reliability during operation since the detent ring is optimally secured against twisting and cannot tilt or become jammed during its axial movements within the guide sleeve. The central opening for the driver inside the detent ring ensures that the locking plate cannot be inserted incorrectly into the guide sleeve. The actuation handle can, furthermore, be cost-effectively manufactured since the guide sleeve can be produced as a unified component and can be inserted into various kinds of handles.

Another embodiment of the invention proposes that the handle neck be provided with a recess on the front surface to serve as a receptacle for the guide sleeve, and that the guide sleeve be provided with a multiangular, for example polygonal, outer contour along its outer circumference at least in some sections, wherein the recess inside the handle neck is provided with an inner contour that matches the shape of said outer contour. This ensures that the guide sleeve is always fixed inside the handle in a non-twisting and stable manner, which has a positive effect on the stability and reliability of the actuation handle.

In order to fixate the guide sleeve inside the handle neck, the outer contour of the guide sleeve is distributed along the circumference and is provided with recesses open to the outside in the corner areas. In this area, the guide sleeve can be fixed inside the handle neck by caulking. Alternatively, or as a supplementary measure, the guide sleeve can also be fixed inside the handle neck by pressing or gluing.

It is furthermore advantageous if the guide sleeve is provided with a passage opening of the same shape as the driver in a central position with respect to the rotary axis of the handle. This results in the driver always being centrally aligned with the guide sleeve in a stable fashion. The driver also protrudes through the guide sleeve into the handle so that the driver is always fixed in a stable and secure position.

To achieve the detent ring always being pressed against the counter detent ring in a reliable manner in order to hold the handle in the designated functional positions, the compression spring of the detent ring is supported on the base of the guide sleeve. This base can also be designed in the shape of a ring.

Another embodiment of the invention equips the handle neck with a front surface facing the installation body and inserts the guide sleeve into the handle neck flush with the front surface of the handle neck. The front surface of the handle neck is used as a bearing and support surface when the handle is mounted on the installation body, which leads to a high degree of stability and reliability for the actuation handle, since this causes the handle to be permanently and securely guided on the installation body.

The guide elements for the detent ring provided on the inner circumference of the guide sleeve are preferably designed as radially inward protruding longitudinal ribs extending in the axial direction, which are arranged along the inner circumference of the guide sleeve at equidistant intervals, while the guide elements provided on the outer circumference of the detent ring are designed as radially inwardly extending longitudinal grooves also extending in the axial direction. Preferably, there are four longitudinal ribs as well as grooves, which are distributed along the circumference at equidistant intervals. Eight longitudinal ribs and grooves would be even more preferable, since this would result in an even more precise and secure bearing for the detent ring. If required, it is also possible to provide more guide elements.

The axial length of the longitudinal ribs of the guide sleeve is preferably longer than the axial length of the longitudinal grooves of the detent ring. This way, it is ensured that the detent ring can move in the axial direction within the guide sleeve in an unhindered manner.

To allow users to clearly recognize the designated functional positions of the handle on the installation body, the first detent element is formed by at least two detent recesses, which are provided on the front surface of the detent ring facing the installation body and are distributed along the circumference at equidistant intervals, while the second detent element is equipped with at least two detent projections corresponding to the detent recesses, which are positioned on the front surface of the counter detent ring facing the handle and are distributed along the circumference at equidistant intervals. To further increase the perceptibility of the functional positions, it would be conceivable to provide four or, preferably, eight detent recesses and detent projections, which are formed on the detent ring and counter detent ring in pairs.

Another embodiment of the invention provides that the installation body is provided with a base body that is composed of a recess aligned centrally with the rotary axis of the handle and is used as a receptacle for the counter detent ring, as well as at least two passage holes for the insertion of the fastening screws, while the base body is itself comprised of a top and bottom side. Such a base body could, for example, be provided by a simple and stable plate that is extremely flat, so that the installation body benefits from a very low construction height. This means that even with standard doors and windows, the highest aesthetic requirements can be met using an actuation handle in accordance with the invention.

It would further be advantageous if the counter detent ring was inserted into the recess of the base body in a positive-locking manner and prevented from twisting by using fitted keys. To this end, the counter detent ring is provided with at least two axial protrusions, for example, on its rear side facing away from the front surface, as the first fitted key element, which engages with the recess of the base body in a positive-locking fashion. In this regard, it is again advantageous if the axial protrusions of the counter detent ring are provided with one recess each along its outer circumference. The recess in the base body, on the other hand, is provided with at least two radial protrusions along its inner circumference, which form the second fitted key element. The protrusions correspond to the recesses in the axial protrusions of the counter detent ring. This not only secures the counter detent ring against twisting, but also holds it inside the base body of the installation body in a stable, reliable, and permanent manner. Assembly-wise, it is simply inserted into the base body. Additional fixation elements or assembly steps are not required at all.

In yet another embodiment, the invention provides that the recess in the base body between the radial protrusions is, in turn, provided with additional radial protrusions, which are positioned between the axial protrusions of the counter detent ring after insertion of the counter detent ring into the recess of the base body. The counter detent ring is thereby permanently and reliably supported by the base body, which has a positive overall effect on the stability of the installation body.

In order to cover up the inserted fastening screws after assembly of the actuation handle, the installation body is equipped with a covering element that is rotatably arranged on the top side of the base body and that covers the top side of the base body in the first rotary position with respect to the base body and allows access to the passage holes in the second rotary position with respect to the base body. The covering element is provided with an opening that is aligned centrally with the rotary axis of the handle and where a flange ring is inserted. This ring is used to axially secure the covering element on the base body.

It is important in this regard that the flange ring is engaged with the counter detent ring in a non-twisting manner, preferably by using fitted keys. This prevents that the covering element inadvertently rotates when the handle is actuated. For this purpose, the flange ring may, for example, be provided with a ring section that protrudes through the opening of the covering element and engages with the counter detent ring in a positive-locking manner, wherein the flange ring is provided with at least two radial protrusions along its inner circumference as a second fitted key element, which correspond to the first fitted key element and therefore the recesses in the axial protrusions of the counter detent ring. This simplifies the construction immensely since no separate support or locking elements are required in the base body for the flange ring either. The latter surrounds the counter detent ring and uses fitted key elements, which hold the counter detent ring inside the base body of the installation body in a non-twisting manner.

In order to axially lock the covering element, the flange ring has a flange edge that is in contact with the top side of the covering element in the area of the opening of the latter. This causes the covering element to be axially secured on the base body. At the same time, the flange edge provides a thrust bearing as well as a slide bearing for the handle. It is important in this regard that the flange edge of the flange ring is provided with a flat front surface, while the front surface forms a bearing area for the handle and/or handle neck. If such a handle where a driver is generally inserted in on the front surface is axially mounted on the installation body, then the handle neck of the handle can sit flush with the flange edge of the flange ring on its front surface so that the handle is stably and precisely mounted on the installation body in a permanent manner. The axial fixation of the handle may be, for example, achieved using one or two locking washers that are placed on the driver in a force-locking or friction-locking manner and that push against the bottom side of the base body of the installation body from below. The anti-twist protection of the flange ring against the base body is provided by complementary fitted keys that are correspondingly provided on the flange ring and the counter detent ring.

With another advantageous development of the invention, a lower covering part is provided on the bottom side of the base body, wherein the covering element and the lower covering part surround the base body in the first rotary position of the covering element. In this regard, the covering element is equipped with an edge that laterally covers the base body and that is interrupted in opposing areas. The lower covering part is also provided with an edge that laterally covers the base body and which is interrupted in opposing areas, wherein the edge of the covering element and the edge of the lower covering part complement each other to form a visually closed edge in the first rotary position of the covering part with respect to the base body.

This results in an appearance of the actuation handle that is always visually unified and closed while only requiring a low construction height since the covering element and the lower covering part surround the base body through the use of which the handle is fastened to a door or window in a manner similar to a housing so that the base body cannot be seen any more from the outside. For the purposes of assembly or disassembly of the base body, the covering element can, however, be turned to the second rotary position with respect to the base body at any time so that the passage holes in the base body and—if present—the fastening screws are accessible. In this regard, the covering element does not have to be lifted either with respect to the base body or the handle, since the covering element always moves on a single level—the level of the lower covering part, which is arranged beneath the base body and is immobile. Therefore, the distance between the handle and the covering element can be reduced to a minimum, since no spring or latching elements are required to hold the covering element on the base body. The installation body in accordance with the invention is designed in a simple and cost-efficient manner and is very easy to handle in general.

The edges of the covering element and the lower covering part are complementary in design, meaning that the edge of the covering element is situated between the edges of the lower covering part and the edge of the covering element and vice-versa when the covering element is in its closed position. Both edges thereby complement each other to form a visually closed edge as soon as the covering element on the bottom side has assumed its first closed rotary position, wherein the covering element and the lower covering part are always at the same height. The height of the edge is dependent on the height of the base body and is particularly adapted to its height, so that the base body is always fully surrounded—also laterally—by the still movable covering element and the lower covering part.

Construction-wise, it is advantageous if the lower covering part is provided with a base with an opening that is centrally aligned with the rotary axis of the handle as well as passage holes for the fastening screws in the same area as the passage holes of the base body.

The covering element and lower covering part are connected with each other in the first rotary position of the covering element in a force-locking, friction-locking, and/or positive-locking manner. This means that the covering element will remain in the first rotary position, meaning that it cannot be inadvertently rotated when the handle is actuated. This connection can optionally be established using detent elements provided on both the covering element and the lower covering part. Alternatively, it would be possible to use suitable clamping or friction elements to fasten the covering element to the lower covering part in such a manner that the connection can be released again.

DESCRIPTION OF THE DRAWINGS

Other features, characteristics, and advantages of the invention result from the wording of the claims as well as the following description of embodiment examples (examples of further development) based on the enclosed drawings, in which:

DETAILED DESCRIPTION OF THE PREFERRED EMBODIMENT

Figure 1:
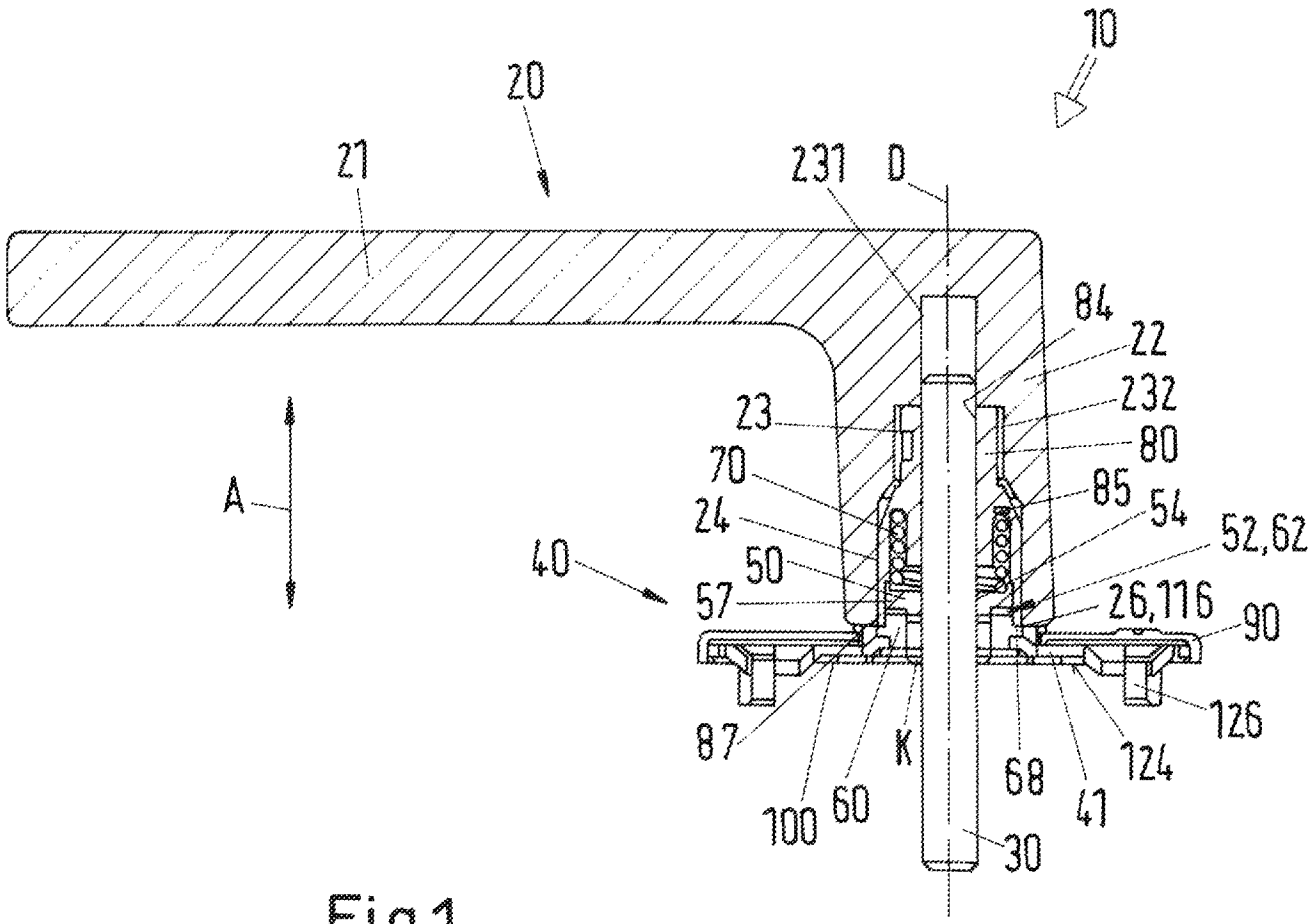
FIG. 1 shows a cross-sectional view of the actuation handle in accordance with the invention with an installation body and the handle rotatably mounted therein.

An actuation handle designated as 10 in FIG. 1 is designed as a window fitting. It is used to open, close, or tilt a window (not shown) that is equipped with tilt and turn fittings. To this end, a tilt and turn mechanism is integrated inside the window and/or inside the window sash (also not shown), which can be operated using the actuation handle 10. The actuation handle 10 is provided with a handle 20 composed of a main handle section 21 and a handle neck 22, which is rotatably mounted on an installation body 40 around a rotary axis D and is in an operative connection with an actuation element (not shown) of the tilt and turn mechanism that is rotatably mounted via a driver 30, which is preferably a square spindle. The actuation element of the tilt and turn mechanism is preferably provided by a gear nut that is centrally equipped with a square recess that serves as a receptacle for the free end of the square spindle 30 in a positive-locking fashion.

The handle neck 22 is provided with a recess 23 that is centrally aligned with the rotary axis D and that is open towards the installation body 40, which serves as a receptacle for the driver 30 in an inner section 231 and a guide sleeve 80 in a front area 232. The inner section 231 of the recess 23 has a cross section that corresponds to the cross section of the driver 30 in such a manner that the driver 30 can be fixed inside the handle neck 20 in a non-rotatable manner. The front section 232 of the recess 23 is provided with a multiangular, preferably octagonal, inner contour 24.

Figure 2:
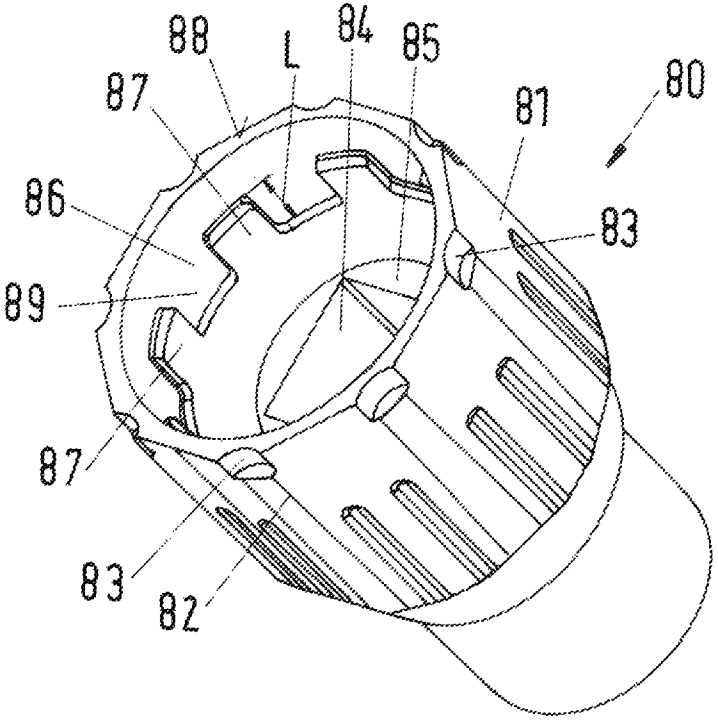
FIG. 2 shows a guide sleeve of the actuation handle.
Figure 3:
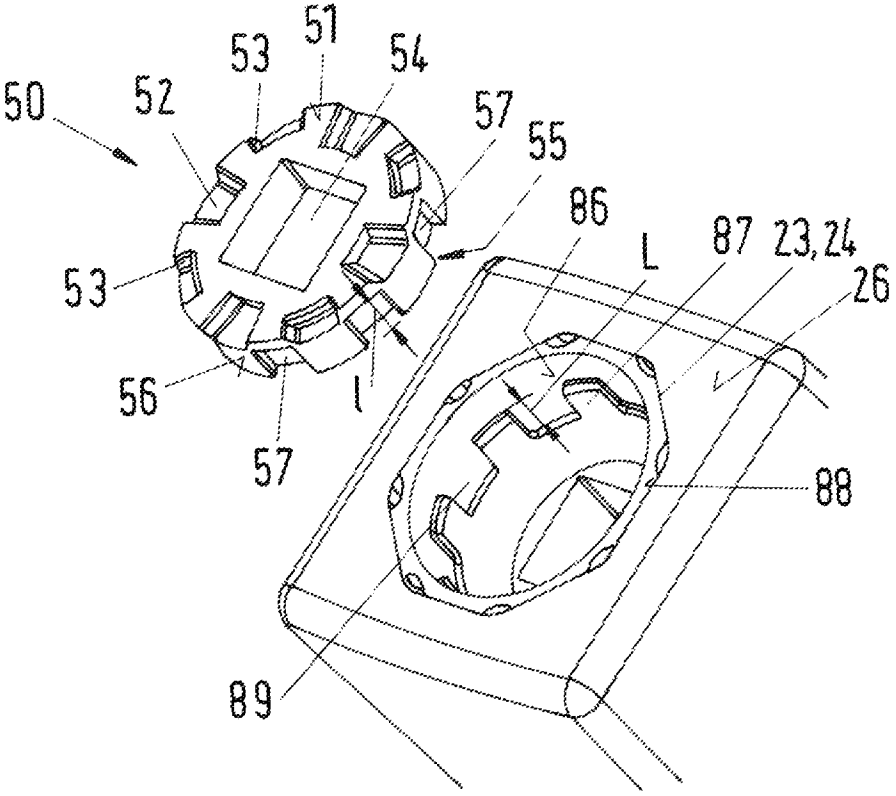
FIG. 3 shows the lower end of the handle and/or handle neck of the actuation handle with its detent ring.

The guide sleeve 80 is shown in detail in FIG. 2, and has an equally octagonal outer contour 82 on its outer circumference 81 that corresponds to the octagonal inner contour 24 of the recess 23 so that the guide sleeve 80 is held inside the recess 23 in a non-rotatable manner. The outer contour 82 of the guide sleeve 80 has eight open recesses 83, which are distributed along its circumference and positioned in the corner areas. In these areas, the guide sleeve 80 may be caulked together with the handle neck 22 after insertion into the recess 23 as is shown in FIG. 3. The guide sleeve 80 is—as shown in FIG. 3—inserted flush with the handle neck 22, wherein the front surface 88 of the guide sleeve 80 is generally flush with the front surface 26 of the neck section 22 that faces the installation body 40. It is important in this regard that the guide sleeve 80 does not protrude over the front surface 26 of the handle neck 26 with its own front surface 88. To serve as an opening for the driver 30, a passage opening 84 with the same shape as the driver 30 is provided within the guide sleeve 80 and centrally aligned with the rotary axis D of the handle so that the driver 30 can be inserted into the inner section 231 of the recess 31 through the guide sleeve 80.

An inner circumference 86 of the guide sleeve 80 is basically cylindrical in shape, while guide elements 87 are provided along the inner circumference 86. These guide elements 87 are longitudinal ribs, which extend in the axial direction A and radially protrude inwardly, so that longitudinal grooves 89 are provided in the axial direction A between these longitudinal ribs 87. The longitudinal ribs 87 and the parallel longitudinal grooves 89 are distributed along the inner circumference 86 of the guide sleeve 80 at equidistant intervals. As shown in the embodiment example of FIG. 2, a total of eight longitudinal ribs 87 and eight recesses 89 are provided. However, it would also be feasible to use a different number. All of the longitudinal ribs 87 are equal to a length L in the axial direction A. They end—as shown in FIGS. 2 and 3—in front of the front surface 88 of the guide sleeve 80.

A detent mechanism is provided between the handle 20 and the installation body 40, which is equipped with axially-acting detent elements (detent recesses 52, detent projections 62) that engage with each another in a force-locking and/or positive-locking manner in at least one functional position of the handle 20. The first detent element or detent recess 52 is provided on a detent ring 50, which is mounted inside the guide sleeve 80 of the handle neck 22 in such a manner that it is movable in the axial direction A and is non-rotatable with respect to the guide sleeve 80. A second detent element or detent projection 62 that corresponds to the first detent recess 52 is provided on an counter detent ring 60, which is inserted into the installation body 40 in a non-movable and non-twisting manner.

The detent ring 50 is a disc with a centrally positioned opening 54 in the same shape as the driver 30 that is positioned inside the guide sleeve 80 in an axially movable fashion. This opening is used as a receptacle for the driver 30, wherein the dimensions of the opening 54 are selected in such a way that the driver 30 can move inside the guide sleeve 80 without being jammed in the opening 54 during the detent movement of the detent ring 80. The detent ring 80 is provided with guide elements 57 along its outer circumference 56, which correspond to the guide elements 87, 89 in the guide sleeve 80. These could, for example, be guide grooves 57 that are radially positioned along the outer circumference 56 corresponding to a length I in the axial direction A and are dimensioned in such a way that the guide elements 87 of the guide sleeve 80 can glide within these, meaning that the guide elements 57 of the detent ring 50 are engaged with the guide elements 87 of the guide sleeve 80 in an axially movable manner. The guide grooves 57 are distributed along the outer circumference 56 of the detent ring 50 at equidistant intervals, wherein the number of guide grooves 57 corresponds to the number of longitudinal ribs 87.

This first detent element 52 could, for example, be provided by detent recesses 52, which are distributed along the circumference at equidistant intervals along the front surface 51 of the detent ring 50 facing the installation body 40. As an example, it might be feasible to provide the detent ring 50 with a total of eight detent recesses 52, which are, in turn, provided with slightly oblique side walls 53 in the circumferential direction.

The second detent element 62 could be provided by detent projections 62, which are distributed along the circumference of the front surface 61 of the counter detent ring 60 at equidistant intervals and which correspond to the detent recesses 52 in the detent ring 80. As an example, it might be feasible to provide the counter detent ring 60 with eight detent projections 62, which are, in turn, provided with slightly oblique side walls 621 in the circumferential direction.

A compression spring 70 is positioned between the detent ring 50 and the guide sleeve 80, which permanently pushes the detent ring 50 against the counter detent ring 60 in the axial direction A. This compression spring 70 is supported by a bottom area 85 within the guide sleeve 80 and the rear side 55 of the detent ring 50. Depending on the size of that compression spring 70—as shown in FIG. 1—it might be feasible to provide an additional circular recess (not designated separately) to serve as a receptacle for the compression spring 70 inside the guide sleeve 80. The bottom area 85 is located at the inner end of this recess in this case.

To allow the detent ring 50 to glide within the guide sleeve 80 along the entire detent stroke of the detent elements 52, 62, the axial length L of the longitudinal ribs 87 of the guide sleeve 80 is larger than the axial length l of the longitudinal grooves 57 of the detent ring 50, wherein both the axial length L of the longitudinal ribs 87 as well as the axial length I of the longitudinal grooves 57 are larger than the axial height (not designated separately) of the detent elements 52, 62. That height defines the detent stroke and thereby the travel range of the detent ring 50 within the guide sleeve 80.

Figure 4:
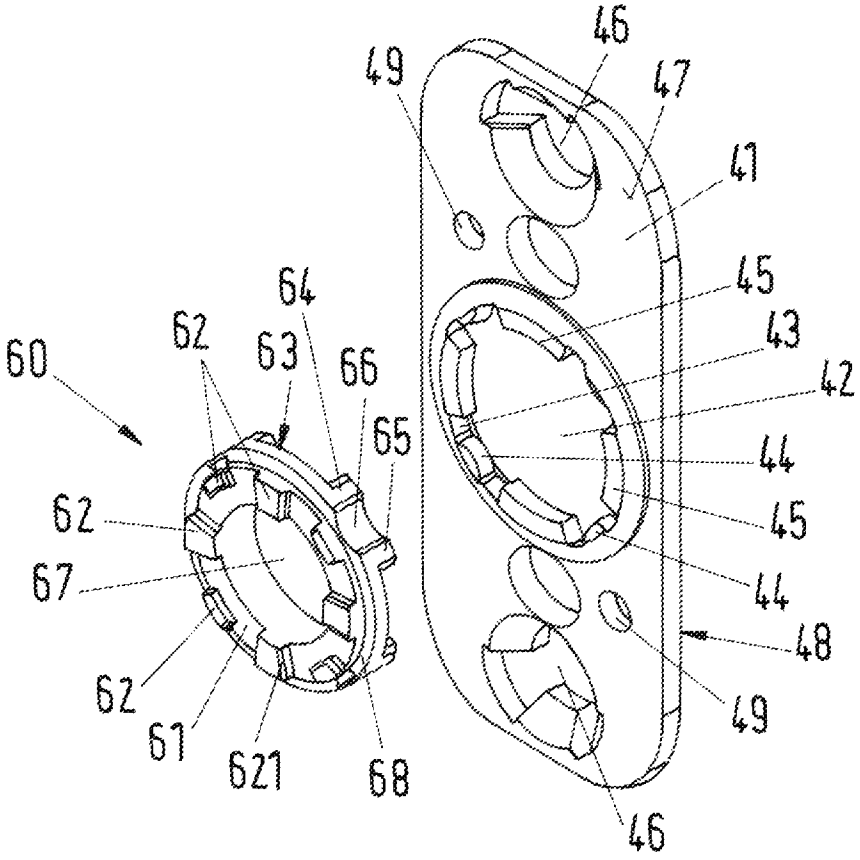
FIG. 4 shows a base body of the installation body of the actuation handle with its counter detent ring.
Figure 5:
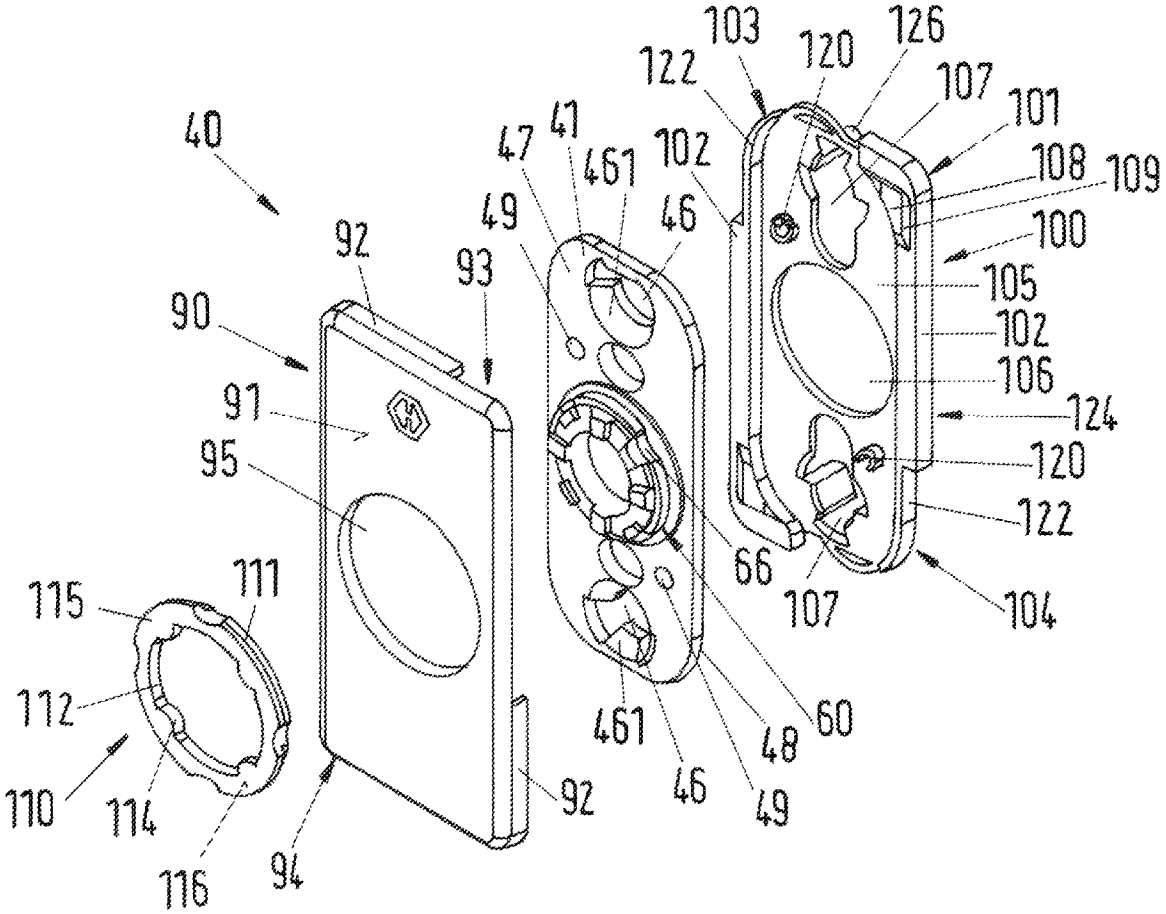
FIG. 5 shows an exploded view of the installation body of the actuation handle in FIG. 1.

The installation body 40 is—as shown in FIGS. 4 and 5—composed of a base body 41 with a recess 42 that is centrally aligned with the rotary axis D of the handle 20 and two passage holes 46 that are arranged symmetrically and which are provided for the purpose of receiving fastening screws (not shown). These fastening screws, which are preferably flat-head screws, are used to fasten the installation body 40 to the window sash. The recess 42 inside the base body 41 is used as a non-rotatable receptacle for the counter detent ring 60, which is inserted into the recess 42 in a positive-locking manner and secured against twisting using fitted keys 44, 64. The base body 41 is preferably designed as a flat plate that consists of a top side 47 and bottom side 48.

The counter detent ring 60 is designed as a disc with a central opening 67 for the driver 30, so that the driver 30 can engage with the actuation element of the tilt and turn mechanism inside the window sash (not shown in the figures) through the counter detent ring 60—with the handle 20 mounted. On the front surface 61 facing the handle 20 and the detent ring 50 of the detent mechanism, the counter detent ring 60 is provided with detent projections 62, which are arranged at equidistant angular distances and which match the detent recesses 52 of the detent ring 50.

The counter detent ring 60 is provided with four axial protrusions 64 (each being a first element of the fitted keys) on the rear side 63 facing away from the handle 20, which are, in turn, each provided with a recess 66 at its outer circumference. Using these axial protrusions 64, the counter detent ring 60 engages with the central recess 42 of the base body 41, which is provided with radially protruding lugs 44 (each being a second element of the fitted keys) that are configured oppositely of the recesses 66 and are positioned along the inner circumference 43 in the same areas as the axial protrusions 64. It is apparent that the axial protrusions 64 on the counter detent ring 60 form the first fitted key element while the radial protrusions 44 along the inner circumference 43 of the recess 42 form the second fitted key element, which—as soon as the counter detent ring 60 is inserted into the recess 42 of the base body 41—engage with each other in pairs and in a positive-locking manner, thereby securing the counter detent ring 60 from twisting with respect to the base body 41.

The inner circumference 43 of the recess 42 is equipped with further radial protrusions 45, which are positioned radially between the axial protrusions 64 of the counter detent ring 60 after insertion of the counter detent ring 60 into the base body 41. In this manner, the counter detent ring 60 is supported by the radial protrusions 45, meaning that the base body 41 constitutes a solid support measure for the counter detent ring 60, which is axially held inside the base body 41 and is immobile in the circumferential direction as well as is engaged with the axially movable and similarly immobile in the circumferential direction detent ring 50 inside the guide sleeve 80.

Figure 6:
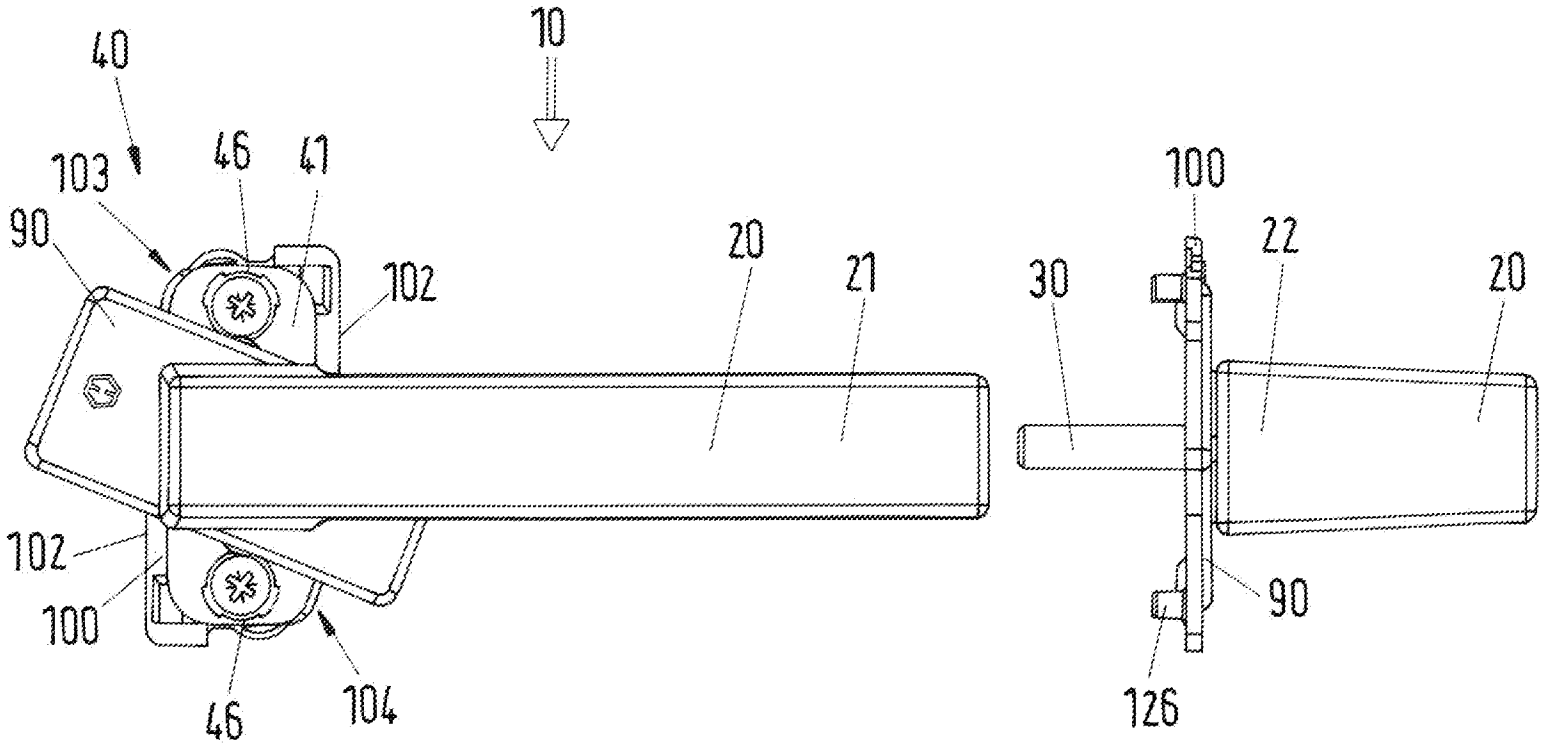
FIG. 6 shows a top view and side view of the actuation handle in FIG. 1 with the cover plate swiveled away.
Figure 7:
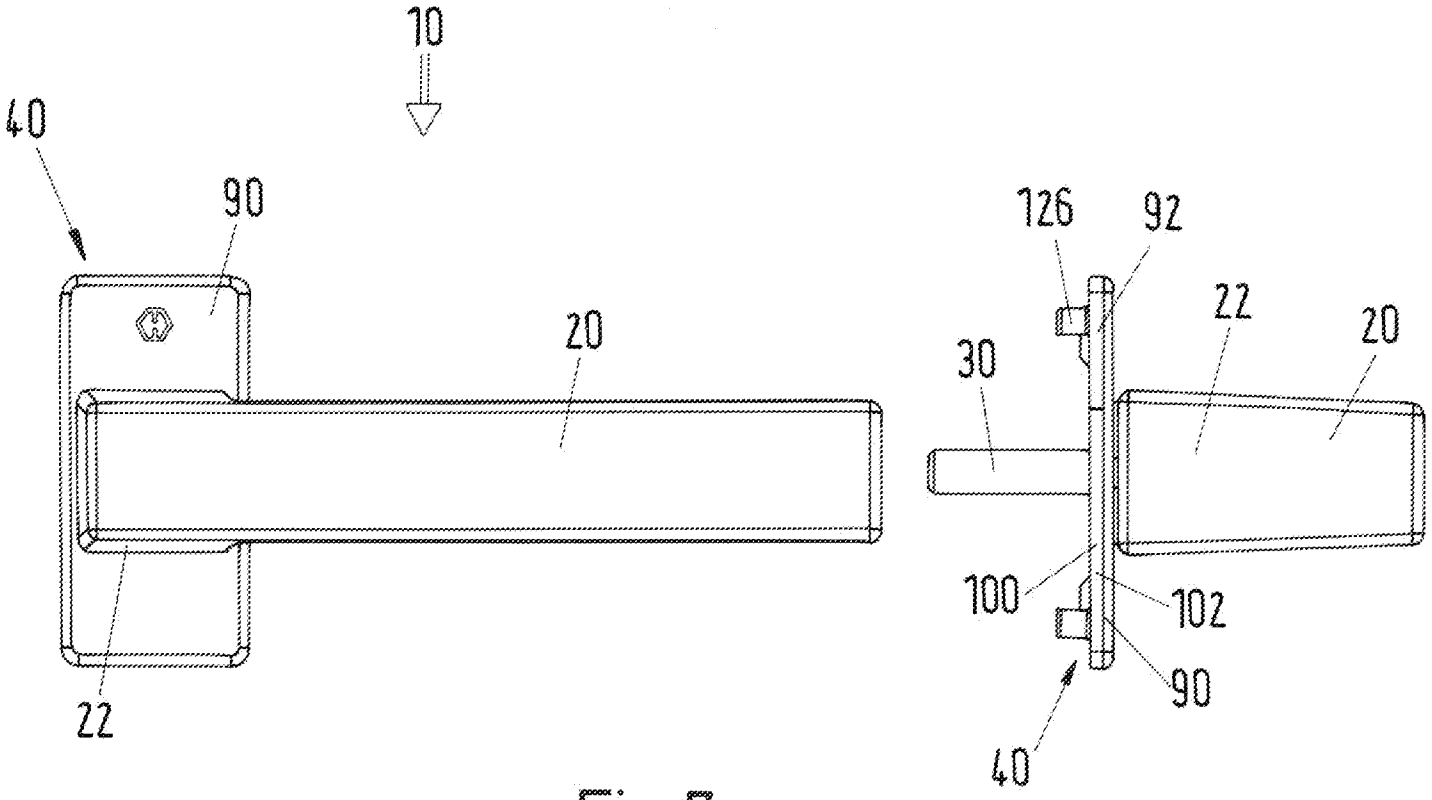
FIG. 7 shows a top view and side view of the actuation handle in FIG. 1 with the cover plate swiveled into place.

A covering element 90 is located above the base body 41, which is rotatably arranged on the top side 47 of the base body 41 and covers the base body 41 in the first rotary position with respect to the base body 41 (also see FIG. 7 in this regard). In the second rotary position with respect to the base body 41, the covering element 90 allows access to the passage holes 46 so that the installation body 40 can be installed using the fastening screws—or the screws can be loosened for disassembly purposes without any problems (also see FIG. 6 in this regard).

The covering element 90 lays flat on the plate 41 and is equipped with a central opening 95 that is, in turn, concentrically aligned with the recess 42 of the base body 41. It is rotatably mounted on the base body 41 via a flange ring 110. The flange ring 110 is preferably provided with an inner circumference 112 that rests on the base body 41 in the axial direction and passes through the opening 95 in the covering element 90—as shown in FIG. 1. It then surrounds the counter detent ring 60 and is connected with the ring in a non-rotatable manner using fitted keys 114. To this end, radial protrusions 114 are provided on the inner circumference of the flange ring 110—as shown in more detail in FIG. 5—which are similar in shape to the recesses 66 inside the axial protrusions 64 of the counter detent ring 60, which means that the other protrusions 114 of the flange ring 110 and the recesses 66 of the counter detent ring 60 also form pairs of fitted key elements in order to prevent the flange ring 110 from twisting. The covering element 90 can therefore be laterally swiveled with respect to the base body 41 without any problem.

In order to axially lock the covering element 90, the flange ring 110 has a flange edge 115 that is in contact with the top side 91 of the covering element 90 in the area of the opening 95 of the covering element. The flange edge 115 of the flange ring 110 is preferably equipped with a flat front surface 116, wherein the handle neck 22 rests on the front surface 116 of the flange ring 110 with its own front surface 26 in a gliding fashion and is supported by the flange ring 110 if the handle 20 is installed.

The axial fixation of the handle 20 on the installation body 10 is preferably achieved using a clamping element K that is firmly positioned on the driver 30 and preferably pressed on the driver 30. The clamping element K is engaged with the side walls of the driver 30 in a force-locking and/or friction-locking manner and is supported on the bottom side 48 of the base body 41. In this manner, the handle 20 is pulled against the front surface 116 of the flange ring 110 with its front surface 26, wherein the handle neck 22 sits flush and stably on the flange edge 115. This results in the handle 20 being stably and precisely mounted on the installation body 10. The front surface 26 of the handle neck 22 and the front surface 116 of the flange ring 110 combine to form a plain bearing for the handle 20, which can easily and precisely be rotated around its rotary axis D. It is apparent that only the flange edge 115 of the flange ring 110 is situated between the handle neck 22 and the covering element 90 so that the gap between the handle 20 and the covering element 90 is reduced to a minimum and therefore barely visible from the outside. In order to improve the strength of the connection between the handle 20 and the installation body 40, it is possible to use two clamping discs K—as shown in FIG. 1.

To stabilize the rotational bearing of the handle 20 on the installation body 40, the counter detent ring 60 can also be provided with a circumferential edge 68, which—as shown in FIGS. 1 and 4—is detached from the front surface 61 in a cascading manner and closes flush with the front surface 116 of the flange ring 110. This results in an enlarged support and bearing area for the handle neck 22 and the flush guide sleeve 80, wherein the front surface 26 of the handle neck 22 rests on the front surface 116 of the flange ring 110 and the circumferential edge 68 of the counter detent ring 60.

The bottom side 48 of the base body 41 is provided with a lower covering part 100, while the covering element 90 and the lower covering part 100 jointly surround the base body 41 in the first rotary position of the covering element 90.

The lower covering part 100, in turn, has a bottom 105 with an opening 106 that is concentrically aligned with the recess 42 of the base body 41. The diameter of the opening 106 is preferably designed to be larger than the outer diameter of the clamping elements K so that these can rest on the bottom side 48 of the base body 41 without problems. In the area of the passage holes 46 of the base body 41, passage holes 107 are provided in the bottom 105 of the lower covering part 100 so that the base body 41 can be fastened on the window sash. The base body 41 rests flat on the bottom 105 of the lower covering part 100, which results in an arrangement that is very stable overall.

To achieve an appearance that the base body is also closed on the sides, meaning visually obscured, the covering element 90 and the lower covering part 100 form a joint circumferential edge 92, 102, which laterally surrounds the base body 41. The covering element 90 is provided with an edge 92 that laterally covers the base body 41, which is separated into opposing areas 93, 94. In these areas 93, 94, the lower covering part 100 has an edge 102 that laterally covers the base body 41, which is also separated into opposing areas 103, 104. These areas are located in the same location as the edge 92 of the covering element 90. This means that the edge 92 of the covering element 90 and the edge 102 of the lower covering part 100 combine to form a visually closed edge that covers the base body in a laterally circumferential manner in the first rotary position of the covering element 90 with respect to the base body 41.

However, due to the separation of the edge 92, 102 it is possible at any time to laterally rotate the covering element 90 with respect to the base body 41 and with respect to the lower covering part 100 at the same level in order to allow access to the fastening screws and passage holes 46. It is not required to lift the covering element 90 in this case. Additional or dedicated spring elements that push the covering element 90 against the base body 41 are no longer required, since the covering element 90 is always held securely and kept rotatable by the flange ring 110.

It is apparent that the covering element 90 and the lower covering part 100 combine to form a kind of housing around the base body 41, which is closed in the first rotary position of the covering element 90 and covers the base body 41 from all sides, but which can at the same time be opened at one level using a simple rotary motion in order to install or remove the base body 41. The covering element 90 acts similarly to a swing top lid for the housing, while the lower covering part 100, which is located between the base body 41 and a window sash (not shown in the figures) when the installation body 40 is in the installed position, constitutes the base of the housing. The edges 92, 102 complement each other in the closed position to form side walls, which cover the base body 41 on the sides. In the opening position, the trailing edges 92 of the covering element 90 form stops for the rotary motion so that the covering element 90 can only be opened and/or twisted to a certain angle—as shown in FIG. 6. The lengths of the respective edges 92, 102 on the covering element 90 and the lower covering part 100 are aligned with each other in such a manner that a rotation of the covering element 90 results in an opening angle that is sufficiently large to allow access to the fastening screws or passage holes 46 and that the edge 92, 102 exhibits a visually closed appearance in the first rotary position of the covering element 90.

To prevent the covering element 90 from inadvertently opening and/or twisting during use of the handle 20 by its own rotary motion, the covering element 90 and the lower covering part 100 may be connected with each other in a force-locking, friction-locking, and/or positive-locking manner in the first rotary position of the covering element 90. For this purpose, the corner areas 101 of the edges 102 of the lower covering part 100 are provided with one chicane 108 each, which keep the covering element 90 in that position when it has been moved to its first rotary position. Such a chicane 108 would, for example, be provided as an elevation, which exhibits lightly elevating flanks 109 to act as running surfaces. A rotation of the covering element 90 from the second rotary position to the first rotary position causes the covering element 90 to be slightly raised at the edges, while the elevation 108 is either in friction-locking contact with the covering element 90, or alternatively the covering element 90 may be provided with a corresponding (not shown) element on its bottom side which engages with the elevation 108. The covering element 90 itself acts as a spring element here.

To prevent the lower covering part 100 from getting lost while the actuation element 10 is not fitted to the door or window, the base body 41 and the lower covering part 100 can be interlocked with each other. For this purpose, two mandrels 120 are provided on the lower covering part 100 that clamp into or interlock with the two holes 49 inside the plate 41.

Furthermore, the lower covering part 100 can be provided with circumferential edge sections 122 that surround the base body 41 on the sides and fit the shape of the latter. The width of the edge section 122 is smaller than the width of the edges 102 so that the covering element 90 with its edges 92 can still fully enter the first rotary position. In this rotary position, the edge section 122 is located behind the edges 92 of the covering element 90.

To ensure that the fastening screws are flush with the top side 47 of the base body 41, every passage opening 46 of the base body 41 comprises a countersunk recess 461 to serve as a receptacle for a screw head. In order to provide an anti-twist mechanism for the installation body 40 on a door leaf or window sash, tappet-like protrusions 126 may be provided on the rear side 124 of the lower covering part 100 facing away from the base body 41. It is apparent that the recesses 461 in the plate 41 and the tappet-like protrusions 126 in the lower covering part 100 complement each other.

Preferably, the covering element 90 and the lower covering part 100 are designed to be symmetrically aligned within the base body 41 with respect to the center point of the recess 42. This simplifies the manufacturing of these elements 90, 100, as well as their handling and assembly.

All characteristics, features, and advantages arising from the claims, the description, and the drawings, including any constructive details, spatial arrangements and process steps, may be crucial to the invention by themselves as well as in various different combinations.

Although the foregoing description of the present invention has been shown and described with reference to particular embodiments and applications thereof, it has been presented for purposes of illustration and description and is not intended to be exhaustive or to limit the invention to the particular embodiments and applications disclosed. It will be apparent to those having ordinary skill in the art that a number of changes, modifications, variations, or alterations to the invention as described herein may be made, none of which depart from the spirit or scope of the present invention. The particular embodiments and applications were chosen and described to provide the best illustration of the principles of the invention and its practical application to thereby enable one of ordinary skill in the art to utilize the invention in various embodiments and with various modifications as are suited to the particular use contemplated. All such changes, modifications, variations, and alterations should therefore be seen as being within the scope of the present invention as determined by the appended claims when interpreted in accordance with the breadth to which they are fairly, legally, and equitably entitled.

While the current application recites particular combinations of features in the claims appended hereto, various embodiments of the invention relate to any combination of any of the features described herein whether or not such combination is currently claimed, and any such combination of features may be claimed in this or future applications. Any of the features, elements, or components of any of the exemplary embodiments discussed above may be claimed alone or in combination with any of the features, elements, or components of any of the other embodiments discussed above.

List of Reference Signs

| | |
|---|---|
| A | Axial direction |
| D | Rotary axis |
| K | Clamping element |
| L | Axial length |
| l | Axial length |
| M | Central point |
| 10 | Actuation handle |
| 20 | Handle |
| 21 | Main handle part |
| 22 | Handle neck |
| 23 | Recess |
| 231 | Inner section |
| 232 | Front section |
| 24 | Inner contour |
| 26 | Front surface |
| 30 | Driver |
| 40 | Installation body |
| 41 | Base body |
| 42 | Recess |
| 43 | Inner circumference |
| 44 | Fitted key/radial protrusion |
| 45 | Other radial protrusion |
| 46 | Passage openings |
| 461 | Receptacle |
| 47 | Top side |
| 48 | Bottom side |
| 49 | Hole |
| 50 | Detent ring |
| 51 | Front surface |
| 52 | Detent element/detent recess |
| 53 | Side wall |
| 54 | Opening |
| 55 | Rear side |
| 56 | Outer circumference |
| 57 | Guide element/longitudinal groove |
| 60 | Counter detent ring |
| 61 | Front surface |
| 62 | Detent element/detent projection |
| 621 | Side flank |
| 63 | Rear side |
| 64 | Fitted key/axial protrusion |
| 65 | Outer circumference |
| 66 | Recess |
| 67 | Opening |
| 68 | Circumferential edge |
| 70 | Compression spring |
| 80 | Guide sleeve |
| 81 | Outer circumference |
| 82 | Outer contour |
| 83 | Recess |
| 84 | Passage opening |
| 85 | Bottom area |
| 86 | Inner circumference |
| 87 | Guide element/longitudinal rib |
| 88 | Front surface |
| 89 | Longitudinal groove |
| 90 | Covering element |
| 91 | Top side |
| 92 | Edge |
| 93 | Area |
| 94 | Area |
| 95 | Opening |
| 100 | Lower covering part |
| 101 | Edge area |
| 102 | Edge |
| 103 | Area |
| 104 | Area |
| 105 | Bottom |
| 106 | Opening |
| 107 | Passage opening |
| 108 | Chicane/elevation |
| 109 | Flank |

-continued

| List of Reference Signs | |
|---|---|
| 110 | Flange ring |
| 112 | Inner circumference |
| 114 | Fitted key/radial protrusion |
| 115 | Flange edge |
| 116 | Front surface |
| 120 | Mandrel |
| 122 | Edge section |
| 124 | Rear side |
| 126 | Tappet-like protrusion |

What is claimed is:

1. An actuation handle assembly for a door or window, comprising:

an installation body arranged to be installed on a door or a window;

a handle having a handle neck, the handle being rotatably connected with the installation body, wherein the handle has a driver that is arranged to form an operative connection with an actuation element in the door or window;

first and second detent elements respectively arranged to engage with each other in at least one functional position of the handle in a force-locking and/or positive-locking manner, wherein the first detent element is a detent recess formed on a detent ring which can be moved in an axial direction (A) and is mounted on the handle neck in a non-rotatable manner, and wherein the second detent element is a detent projection provided on a counter detent ring that is mounted on the installation body in a non-twisting manner, wherein the detent projection corresponds to the detent recess; and a compression spring positioned in the handle neck and arranged to push the detent ring against the counter detent ring in the axial direction (A);

wherein the handle neck is provided with a guide sleeve, which receives the driver in a non-rotatable manner in a central position with respect to a rotary axis (D) of the handle and which is provided with guide elements along its inner circumference;

wherein the detent ring has an identically shaped opening with respect to the driver in a central position as aligned with the rotary axis (D) of the handle and additionally has guide elements located along its outer circumference;

wherein the detent ring is inserted into the guide sleeve with an opening in the detent ring serving as a receptacle for the driver- and guide elements of the detent ring engage with guide elements on the guide sleeve in an axially-movable fashion;

wherein the installation body comprises a base body having a recess located therein which is aligned centrally with the rotary axis (D) of the handle, the base body also having at least two passage holes located therein which are arranged to serve as receptacles for fastening screws, and wherein the base body has a top side and a bottom side;

wherein the installation body further comprises a covering element that is rotatably mounted on the top side of the base body, the covering element being moveable between a first rotary position with respect to the base body in which the covering element covers the base body and a second rotary position with respect to the base body in which the covering element allows access to the passage holes in the base body;

wherein the covering element is rotatably mounted on the base body using a flange ring; and wherein the flange ring and the counter detent ring each have fitted key elements that are respectively arranged to facilitate the flange ring and the counter detent ring to engage each other in a non-twisting manner.

2. An actuation handle assembly as defined in claim 1, the handle neck has a recess which serves as a receptacle for the guide sleeve and which is located on a front surface of the handle neck; and wherein the guide sleeve has a multiangular outer contour located along at least a portion of its outer circumference; and wherein the recess in the handle neck has an inner contour of a shape that matches the outer contour of the guide sleeve.

3. An actuation handle assembly as defined in claim 1, wherein the guide sleeve has a passage opening having a shape identical to a shape of the driver in a central position relative to the rotary axis (D) of the handle.

4. An actuation handle assembly as defined in claim 1, wherein the handle neck has a front surface facing the installation body and wherein the guide sleeve is inserted into the handle neck in a manner wherein it closes flush with the front surface of the handle neck.

5. An actuation handle assembly as defined in claim 1, wherein the first detent element comprises at least two detent recesses, which are distributed along a circumference of a front surface of the detent ring facing the installation body at equidistant intervals.

6. An actuation handle assembly as defined in claim 5, wherein the second detent element comprises at least two detent projections corresponding to the detent recesses, which detent projections are distributed along the circumference on a front surface of the counter detent ring facing the handle at equidistant intervals.

7. An actuation handle assembly as defined in claim 1, wherein the counter detent ring is arranged to be inserted into the recess of the base body in a positive-locking fashion and is secured against twisting by fitted key elements respectively located in the counter detent ring and the base body.

8. An actuation handle assembly as defined in claim 1, wherein the covering element has an opening that is centrally aligned with the rotary axis (D) of the handle.

9. An actuation handle assembly as defined in claim 1, wherein the flange ring comprises a flange edge which is in contact with a top side of the covering element in the area of an opening therein.

10. An actuation handle assembly as defined in claim 9, wherein the flange edge of the flange ring has a front surface, wherein a front surface of the handle neck is positioned on the front surface of the flange ring in a gliding fashion.

11. An actuation handle assembly as defined in claim 1, additionally comprising a lower covering part located on the bottom side of the base body, wherein the covering element and the lower covering part are respectively arranged to collectively surround the base body when the covering element is in its first rotary position with respect to the base body.

12. An actuation handle assembly as defined in claim 11, wherein the covering element comprises an edge that laterally covers a portion of the base body, wherein the edge of the covering element is separated into two opposing areas; and wherein the lower covering part comprises an edge that laterally covers a portion of the base body, wherein the edge of the lower covering part is separated into two opposing areas; and wherein the edges of the covering element and the lower covering part are respectively arranged such that the edge of the covering element and the edge of the lower covering part collectively form a visually closed edge when the covering element is in the its first rotary position with respect to the base body.

* * * * *